US006122863A

United States Patent [19]

Tippin et al.

[11] Patent Number: 6,122,863

[45] Date of Patent: Sep. 26, 2000

[54] OPERATOR FOR A CLOSURE

[75] Inventors: Arthur David Tippin, Edgbaston; Peter James Harrison, Wednesbury, both of United Kingdom

[73] Assignee: Hardware & Systems Patents Limited, London, United Kingdom

[21] Appl. No.: 08/957,373

[22] Filed: Oct. 24, 1997

[30] Foreign Application Priority Data

Dec. 20, 1996 [GB] United Kingdom ..... 9626515

[51] Int. Cl.[7] ..... E05F 11/02

[52] U.S. Cl. ..... 49/279; 49/295; 49/341

[58] Field of Search ..... 49/279, 282, 283, 49/293, 294, 291, 295, 341, 345, 343

[56] References Cited

U.S. PATENT DOCUMENTS

| | | | |
|---|---|---|---|
| 4,136,578 | 1/1979 | Van Klompenburg | 49/345 |
| 4,617,758 | 10/1986 | Vetter | 49/279 |
| 5,050,345 | 9/1991 | Nakanishi | 49/279 |
| 5,054,239 | 10/1991 | Tucker et al. | 49/279 |
| 5,111,615 | 5/1992 | Kuhnt et al. | 49/279 |
| 5,152,103 | 10/1992 | Tucker et al. . | |
| 5,531,045 | 7/1996 | Piltingsrud . | |

FOREIGN PATENT DOCUMENTS

| | | |
|---|---|---|
| 0 323 241 A1 | 7/1989 | European Pat. Off. . |
| 0 450 227 A1 | 10/1991 | European Pat. Off. . |
| 2283783 | 5/1995 | United Kingdom . |

*Primary Examiner*—Daniel P. Stodola
*Assistant Examiner*—Curtis A. Cohen
*Attorney, Agent, or Firm*—Larson & Taylor

[57] ABSTRACT

A self-locking window operator has a reversible rotary drive shaft connectable in sequence to separate linkages respectively controlling movement of a casement relative to a surrounding frame and actuation of a fastening mechanism for releasably securing the casement when closed. The drive shaft is coupled by a worm gear to a drive input member rotatable about a drive axis and each linkage has a drive output member rotatable about separate axes offset from the drive axis. The input member has a drive pin co-operable with a respective pin receiving recess of each output member for sequentially operating the linkages.

19 Claims, 7 Drawing Sheets

OPERATOR FOR A CLOSURE

BACKGROUND OF THE INVENTION

This invention relates to an operator for a closure comprising a wing frame supported for movement relative to a surrounding frame and in particular, though not exclusively for a casement window.

Window operators are known which combine movement of the wing frame with actuation of a locking mechanism to unlock the wing frame when the operator is operated to open the wing frame and to lock the wing frame when the operator is operated to close the wing frame.

It is important for such operation that movement of the wing frame and actuation of the locking mechanism is controlled in sequence and many known operators have complex arrangements of gears and links to provide the required sequence.

The operator disclosed in our UK Patent No.2283783-B has a drive input member and separate drive output members controlling movement of the wing frame and actuation of the locking mechanism. The drive members are arranged in a stack for rotation about a common axis with each output member being coupled to the input member in sequence to provide the required movement of the wing and actuation of the locking mechanism. While the stacked arrangement of the drive members is relatively simple and is generally found to work satisfactorily, the space required to accommodate the height of the stack can restrict installation of the operator.

SUMMARY OF THE INVENTION

The present invention has been made from a consideration of this problem and has for its object the provision of an improved operator for sequentially controlling movement of the wing frame and actuation of the locking mechanism.

This object is broadly accomplished by arranging drive output members controlling movement of the wing frame and actuation of the locking mechanism respectively for rotation about separate axes. With this arrangement, the drive output members can be located in a common plane reducing the overall height of the drive mechanism compared to the stacked arrangement of the drive members disclosed in our UK Patent No.2283783-B.

Other features, benefits and advantages of the invention will be apparent from the following detailed description of an exemplary embodiment of window operator shown in the accompanying drawings.

DETAILED DESCRIPTION OF THE EXEMPLARY EMBODIMENTS

Figure 1:
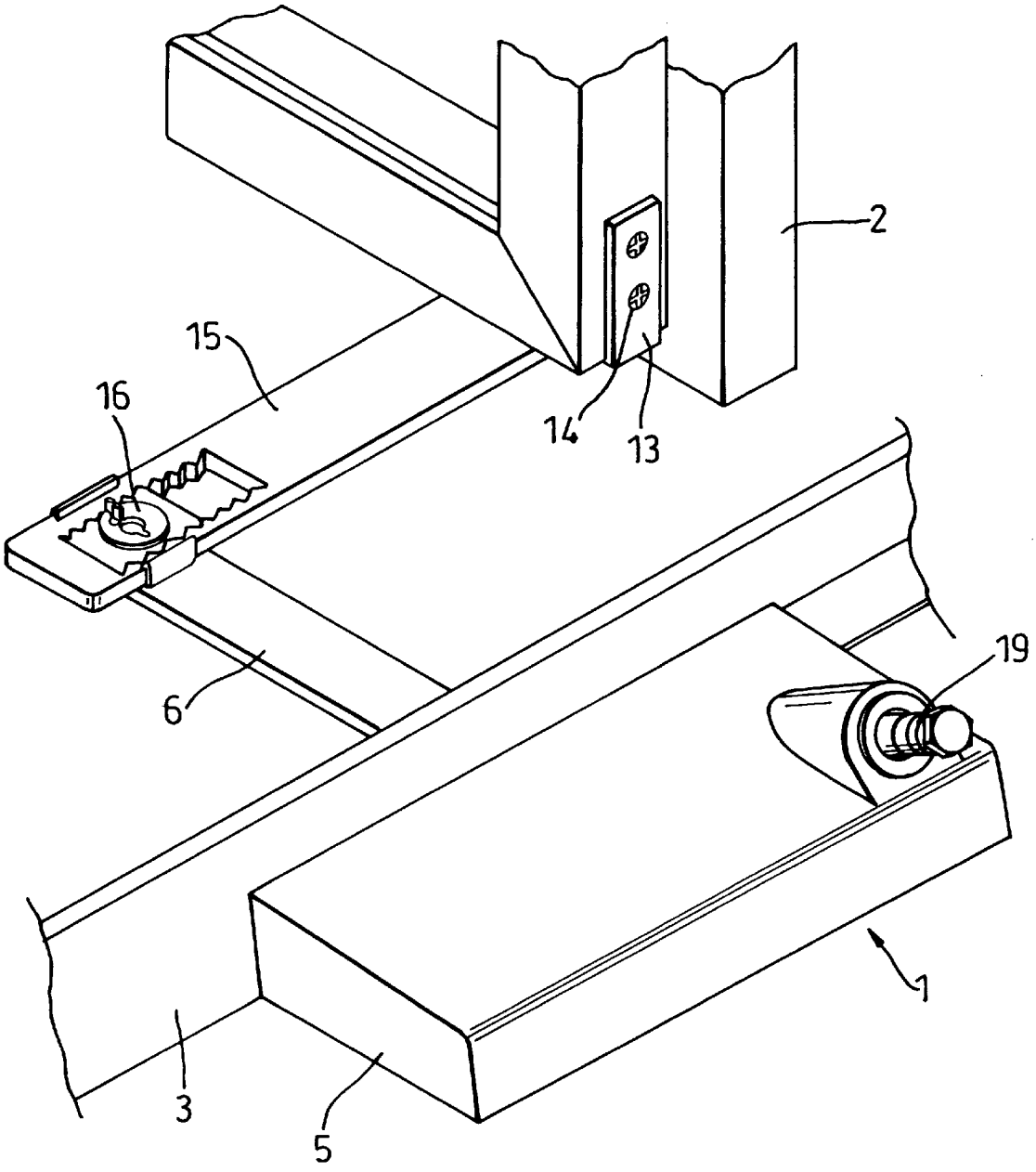
FIG. 1 is a perspective view of part of a casement window showing the operator mounted on the fixed frame and connected to the open casement.
Figure 2:
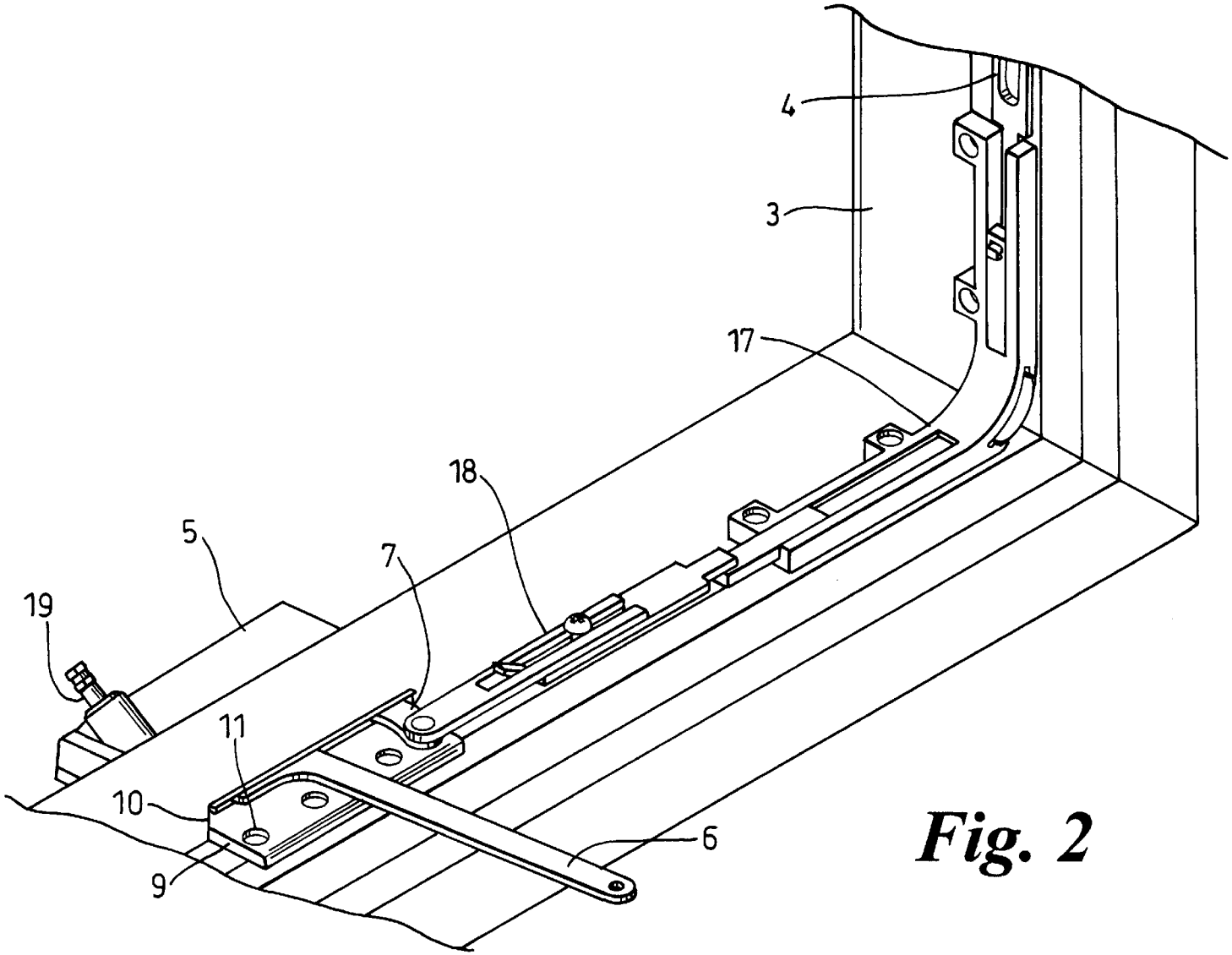
FIG. 2 is a perspective view of part of the fixed frame showing the operator connected to the locking mechanism.
Figure 3:
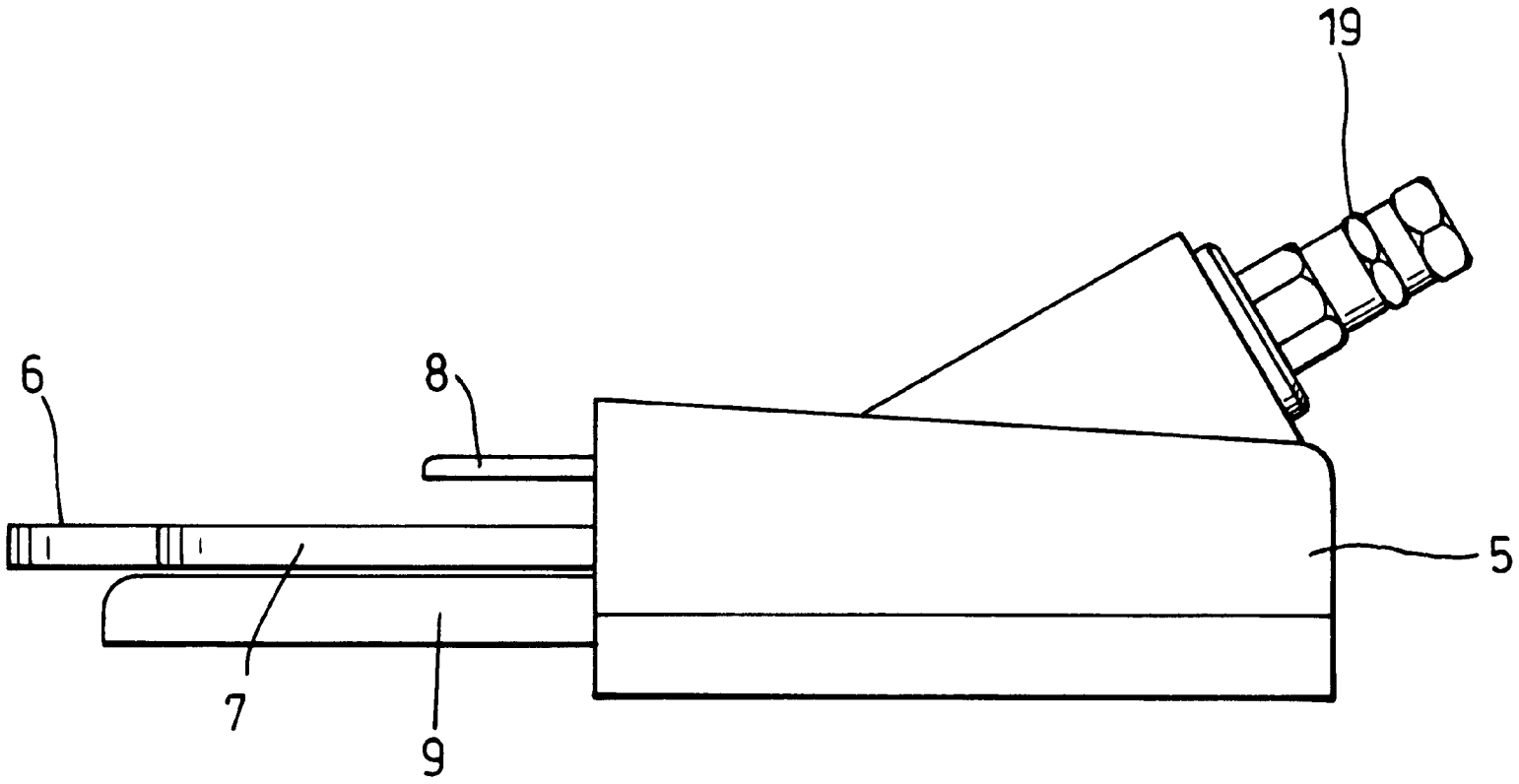
FIG. 3 is a end view of the operator.
Figure 4:
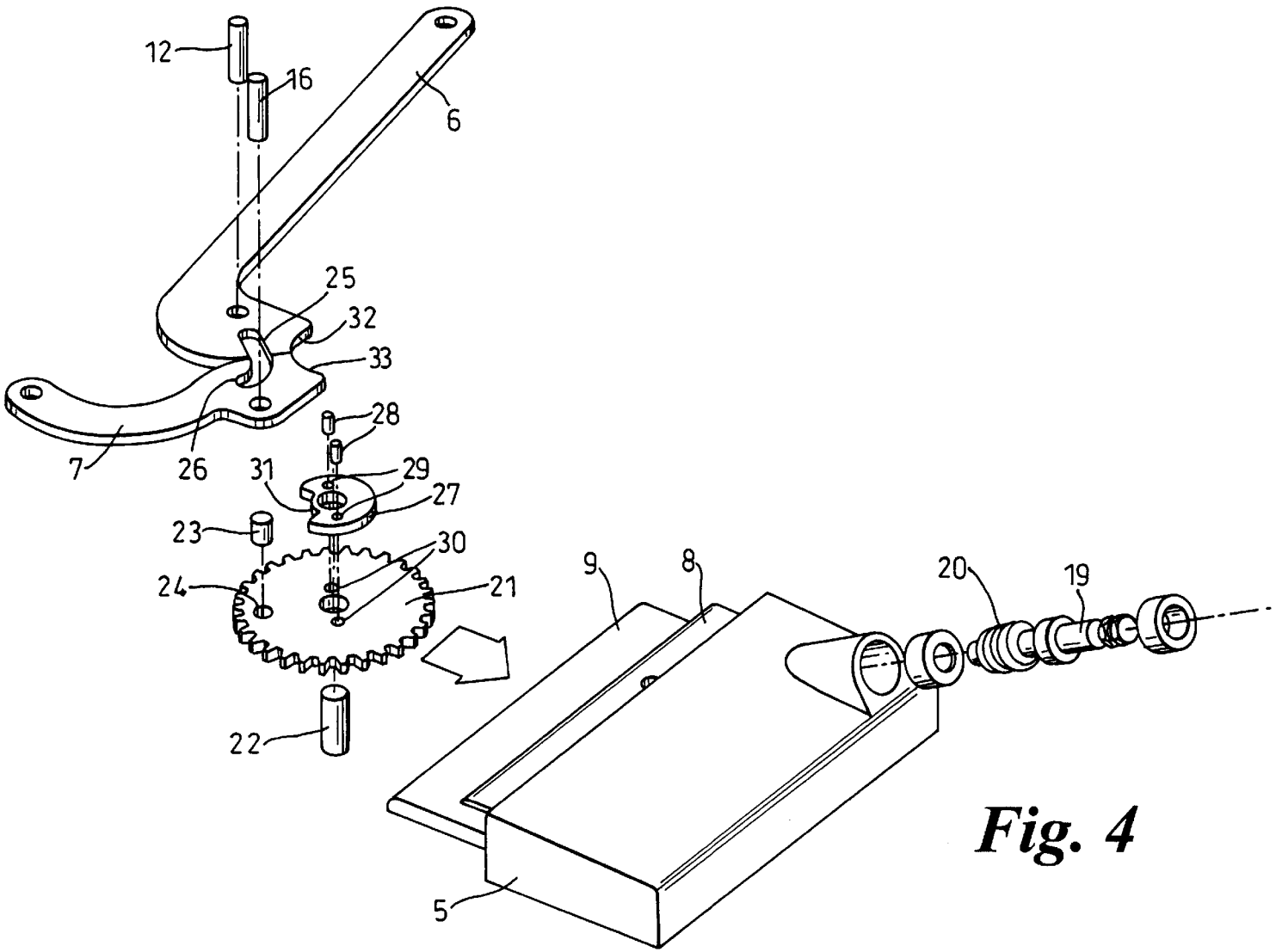
FIG. 4 is an exploded isometric view showing the component parts of the operator.

The accompanying drawings depict an operator 1 for moving a casement 2 supported in a surrounding frame 3 between open and closed positions and for releasably locking the casement 2 in its closed position.

In this embodiment, the casement 2 is supported by hinges (not shown) for pivotal movement about a vertical axis between the open and closed positions and is releasably locked in the closed position by engagement of one or more bolting members (not shown) carried by a lock bar 4 mounted for vertical sliding movement on the frame 3 with corresponding keepers (not shown) on the casement 2.

The operator has a generally rectangular casing 5 from which co-planar drive arms 6 and 7 extend on one side between an upper flange 8 and a wider lower flange 9. The flanges 8,9 are located in a through slot 10 formed in the frame 3 and the lower flange 9 has a series of holes 11 for screws (not shown) used to fix the casing 5 to the frame 3.

The drive arm 6 is mounted for rotation about a fixed axis defined by a pin 12 secured within the casing 5. An angle bracket 13 secured to the bottom corner of the casement 2 by screws 14 is connected to the drive arm 6 by a link 15 so that rotation of the drive arm 6 in one direction causes the casement 2 to move to the open position and rotation of the drive arm 6 in the opposite direction causes the casement 2 to move to the closed position.

A pivot joint 16 between the drive arm 6 and the link 15 is adjustable in the direction of the length of the link 15 to allow fine adjustment of the connection to the casement 2 on installation of the operator 1.

The drive arm 7 is mounted for rotation about a fixed axis defined by a pin 16 secured within the casing 5 parallel to and offset from the pin 12. The lock bar 4 is connected to the drive arm 7 by a corner drive unit 17 fixed to the frame 3 so that rotation of the drive arm 7 in one direction causes the lock bar 4 to move to unlock the casement 2 and rotation of the drive arm 7 in the opposite direction causes the lock bar 4 to move to lock the casement 2.

The corner drive unit 17 has a flexible metal strip guided for sliding movement around the bottom corner of the frame 3 and a link 18 between the drive unit 17 and the drive arm 7 is length adjustable to allow fine adjustment of the connection to the lock bar 4 on installation of the operator 1.

The casing 5 mounts a drive shaft 19 having a worm 20 at the inner end and a handle (not shown) at the outer end for rotating the shaft 19. The handle may be foldable from an inactive or stored position to an active or extended position for actuation of the operator 1 and may be detachable to prevent unauthorised actuation of the operator 1. Alternatively, the outer end of the drive shaft 19 may be connectable to an electric motor for rotating the shaft 19.

The worm 20 meshes with a worm drive wheel 21 mounted for rotation about a fixed axis defined by a pin 22 secured within the casing 5 parallel to and offset from the pins 12 and 16 so that reversing rotation of the drive shaft 19 causes the worm wheel 21 to rotate in opposite directions.

As shown, the pivot axes of the drive arms 6,7 subtend an angle of approximately 90° at the pivot axis of the worm wheel 21 and are substantially equally spaced therefrom.

A drive pin 23 is secured to the worm wheel 21 in a hole 24 offset from the axis of rotation of the worm wheel 21 and is co-operable with a slot 25 in the drive arm 6 and a slot 26 in the drive arm 7 for rotating the drive arms 6,7 in sequence.

A part circular stop plate 27 is located on the pin 22 and is secured to the worm wheel 21 by a pair of lock pins 28 received in holes 29 in the stop plate 27 and aligned holes 30 in the worm wheel 21.

The stop plate 27 is co-operable at opposite ends of an approximately 90° cut-out 31 with an abutment 32 defined by a curved marginal edge portion of the drive arm 6 and with an abutment 33 defined by a curved marginal edge portion of the drive arm 7 for blocking rotation of the drive arms 6,7 in sequence.

Figure 5:
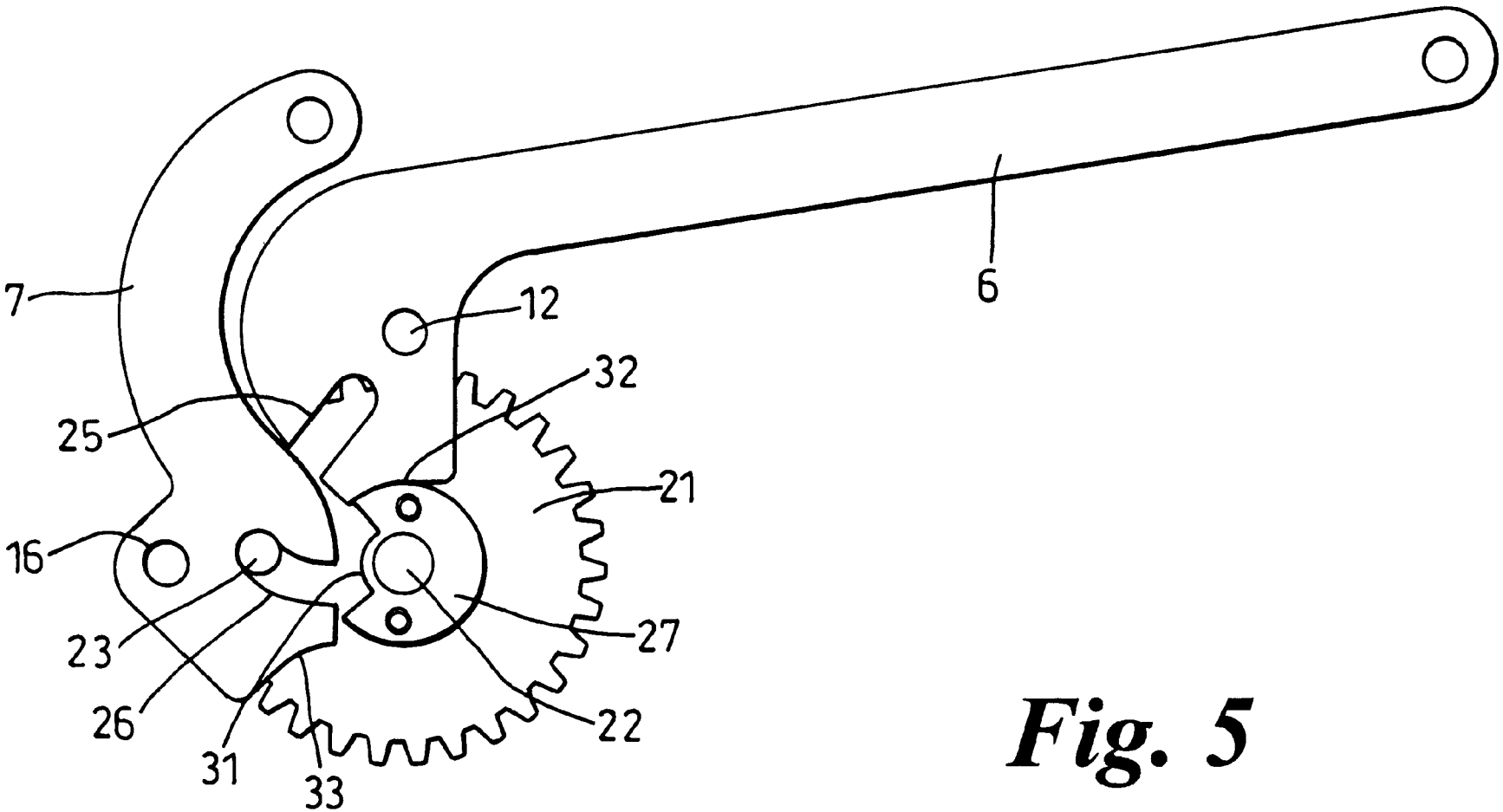
FIG. 5 is a plan view showing the drive mechanism of the operator corresponding to the closed and locked condition of the casement.
Figure 6:
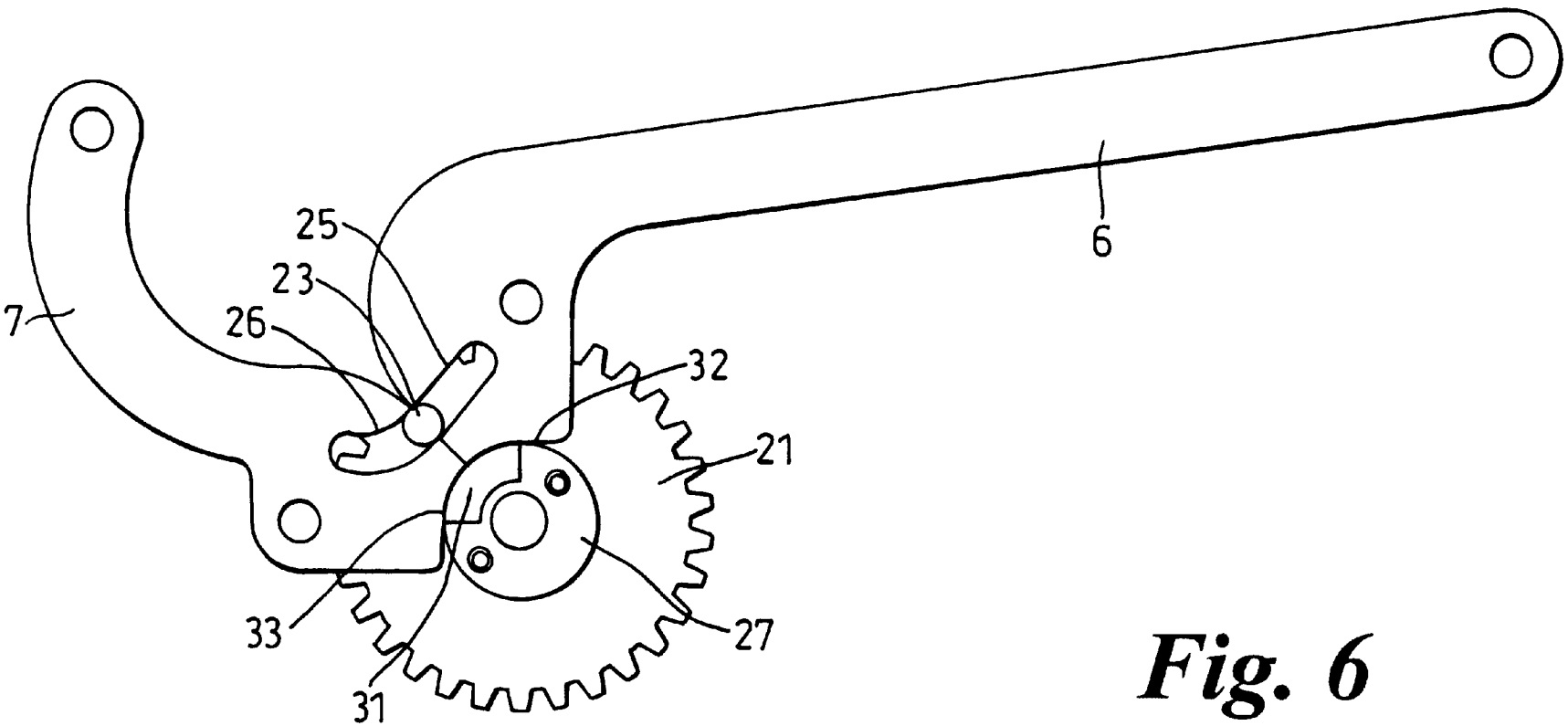
FIG. 6 is a plan view showing the drive mechanism of the operator corresponding to the closed and unlocked condition of the casement.
Figure 7:
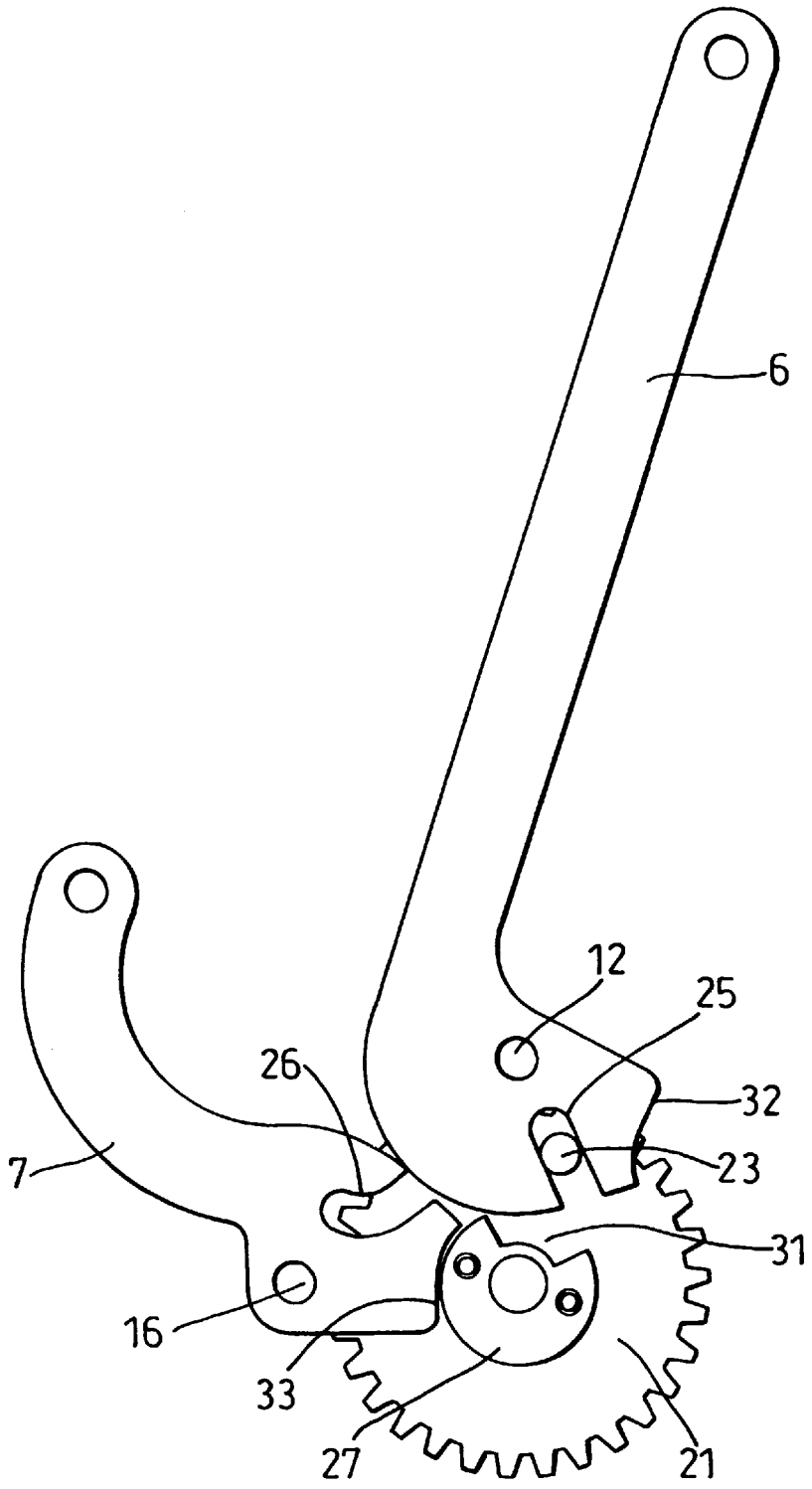
FIG. 7 is a plan view showing the drive mechanism of the operator corresponding to the open and unlocked condition of the casement.

Sequential operation of the above-described operator 1 will be understood from the following description with particular reference to FIGS. 5, 6 and 7.

When the casement 2 is closed and locked, the drive pin 23 is located at the inner end of the slot 26 in the drive arm 7, and the stop plate 27 is engaged with the abutment 32 on the drive arm 6 as shown in FIG. 5.

Rotation of the drive shaft 19 to produce clockwise rotation of the worm wheel 21 causes the drive pin 23 to co-act with the slot 26 to produce anticlockwise rotation of the drive arm 7 to move the lock bar 4 to unlock the casement 2 as shown in FIG. 6. At the same time, the stop plate 27 co-acts with the abutment 32 to block rotation of the drive arm 6 to keep the casement 2 in the closed position.

When the casement 2 is closed and unlocked, the outer end of the slot 26 in the drive arm 7 is aligned with the outer end of the slot 25 in the drive arm 6 and the drive pin 23 is located at the junction therebetween as shown in FIG. 6. At the same time, the stop plate 27 co-acts with the abutment 32 on the drive arm 6 and the abutment 33 on the drive arm 7 to block rotation of both drive arms 6,7.

Continued rotation of the drive shaft 19 to produce clockwise rotation of the worm wheel 21 causes the drive pin 23 to enter and co-act with the slot 25 in the drive arm 6 causing anticlockwise rotation of the drive arm 6 to open the casement 2 as shown in FIG. 7. At the same time, the stop plate 27 co-acts with the abutment 33 to block rotation of the drive arm 7 to keep the lock bar 4 in the unlocked position.

When the casement 2 is open and unlocked, rotating the drive shaft 19 in the opposite direction to produce anticlockwise rotation of the worm wheel 21 causes the above-described operation to be reversed to close and lock the casement 2.

As will be appreciated from the foregoing description of an exemplary embodiment, the invented operator is of simple construction facilitating manufacture and installation. In particular, the co-planar arrangement of the drive arms resulting from offsetting the pivot axes reduces the height of the operator compared to the operator described in our earlier UK Patent No.2283783-B.

Further, this simple construction is combined with reliable operation which functions automatically to unlock and open the casement in response to rotation of the drive shaft in one direction and to close and lock the casement in response to rotation of the drive shaft in the opposite direction. In particular, the arrangement of the drive pin and stop plate ensures the drive arms are coupled and uncoupled in the required sequence.

Other advantages of the invented operator will be apparent to those skilled in the art and it will be understood that the invented operator has application to windows in which the casement is supported in a surrounding frame for pivotal movement about either a vertical axis as described or a horizontal axis as well as other types of closures such as doors.

Furthermore, it will be understood that various changes can be made to the form and shape of the exemplary embodiment of the invented operator whilst not departing from the concept of a substantially co-planar arrangement of the drive arms controlling movement of the casement and actuation of the locking mechanism to provide a reduction in the overall height of the drive mechanism compared to that disclosed in our aforementioned UK Patent No.2283783-B.

For example, the casing may have any suitable shape for housing the drive mechanism and/or be adapted for securing to the frame by any suitable means. The drive wheel may be connected to the drive shaft by any suitable gear arrangement for reversing rotation of the drive wheel. The drive arms may have any suitable shape and/or be adapted for connection to the wing and locking mechanism by any suitable means. The pivot axes of the drive arms may be arranged at an angle other than 90° relative to the pivot axis of drive wheel and/or may be at the same or different distances from the pivot axis of the drive wheel. The arrangement of the coupling pin and slots for rotating the drive arms in sequence may be replaced by any other suitable coupling means. The arrangement of the stop plate and abutments for blocking rotation of the drive arms in sequence may be replaced by any other suitable stop means. The locking mechanism may be of any type providing either single point locking or multi-point locking with simultaneous or sequential engagement of the bolting members and keepers.

We claim:

1. An operator for a closure comprising a drive mechanism for controlling respectively pivotal movement of the closure relative to a closure frame and actuation of a fastening mechanism for securing the closure relative to the closure frame when the closure frame is closed wherein said drive mechanism comprises a drive input rotatable about a drive axis, a first drive output rotatable about a first axis offset from said drive axis for controlling pivotal movement of the closure between open and closed positions, a second drive output substantially co-planar with said first drive output and rotatable about a second axis offset from said drive axis for controlling the fastening mechanism for releasably securing the closure when closed, means for coupling said drive input to each of said first and second drive outputs in sequence whereby said first drive output is coupled to said drive input for opening and closing the closure when said second drive output is uncoupled with the fastening mechanism unlocked, and said second drive output is coupled to said drive input for locking and unlocking the fastening mechanism when said first drive output is uncoupled with the closure closed, and means for blocking rotation of each of said first and second drive outputs when uncoupled from said drive input.

2. An operator according to claim 1 wherein said coupling means includes a drive member rotatable with said drive input and co-operable with each of said first and second drive outputs.

3. An operator according to claim 2 wherein said drive member comprises a pin and each of said first and second drive outputs has a respective recess co-operable with said pin to transmit rotation of said drive input to each of said first and second drive outputs when coupled to said drive input.

4. An operator according to claim 3 wherein each recess is open at one end and said open ends are alignable for transfer of said pin therebetween during change-over of coupling of said drive input from one to the other of said first and second drive outputs.

5. An operator according to claim 1 wherein said blocking means includes a stop member rotatable with said drive input and co-operable with each of said first and second drive outputs in sequence.

6. An operator according to claim 5 wherein each of said first and second drive outputs has a respective abutment member co-operable with said stop member to block rotation of each of said first and second drive outputs when uncoupled from said drive input.

7. An operator according to claim 1 wherein said blocking means is operable to block rotation of both of said first and second drive outputs during change-over of coupling of said drive input from one to the other of said first and second drive outputs.

8. An operator according to claim 1 wherein said first and second axes subtend an angle of approximately 90° at said drive axis.

9. An operator according to claim 1 wherein said drive input is rotatable in one direction for unlocking and opening the closure, and in the opposite direction for closing and locking the closure.

10. An operator according to claim 9 wherein said drive input is operable by a reversible rotary actuator.

11. An operator according to claim 1 wherein said first drive output includes a hinge linkage connectable to the closure.

12. An operator according to claim 11 wherein said hinge linkage includes means for adjusting the length thereof.

13. An operator according to claim 1 wherein said second drive output includes a lock linkage connectable to the fastening mechanism.

14. An operator according to claim 13 wherein said lock linkage has means for extending said lock linkage around a corner of the closure frame.

15. An operator according to claim 14 wherein said extension means comprises a flexible corner drive unit.

16. An operator according to claim 15 wherein said lock linkage includes means for adjusting the length thereof.

17. An operator for a closure comprising a drive mechanism for controlling respectively pivotal movement of the closure relative to a closure frame and actuation of a fastening mechanism for securing the closure relative to the closure frame when the closure is closed, wherein said drive mechanism comprises a drive input rotatable about a fixed drive axis, a first drive output rotatable about a fixed first axis offset from said drive axis for controlling pivotal movement of the closure between open and closed positions, a second drive output rotatable about a fixed second axis offset from said drive axis for controlling the fastening mechanism for releasably securing the closure when closed, and means for coupling said drive input to each of said first and second drive outputs in sequence whereby said first drive output is coupled to said first drive output for opening and closing the closure when said second drive output is uncoupled with the fastening mechanism unlocked, and said second drive output is coupled to said first drive input for locking and unlocking the fastening mechanism when said first drive output is uncoupled with the closure closed.

18. A dual function window operator comprising a drive mechanism mountable on a wing frame for controlling pivotal movement of an opening wing relative to the wing frame and actuation of a fastening mechanism mountable on the wing frame for securing the wing closed relative to the wing frame, said drive mechanism comprising:

a drive input rotatable about a drive axis under the control of a reversible rotary actuator;

first and second substantially co-planar drive outputs rotatable about separate axes offset from said drive axis for actuating a hinge linkage connectable to the opening wing and a lock linkage connectable to the fastening mechanism respectively; and control means responsive to rotation of said drive input for controlling rotation of said first and second drive outputs in sequence whereby rotation of said actuator in one direction is transmitted to said drive outputs to unlock and open the wing and rotation of said actuator in the opposed direction is transmitted to said drive outputs to close and lock the wing, said control means including a drive pin rotatable with said drive input and engageable with a respective drive recess in each of said drive outputs in turn for effecting rotation of said drive outputs.

19. A dual function window operator according to claim 18, wherein said control means further includes a blocking cam rotatable with said drive input and engageable with a respective cam follower on each of said drive outputs in turn for preventing rotation of said drive outputs.

* * * * *